US011450974B2

(12) United States Patent
Neisius et al.

(10) Patent No.: US 11,450,974 B2
(45) Date of Patent: Sep. 20, 2022

(54) ELECTRICAL CONTACT, SYSTEM AND METHOD FOR MANUFACTURING AN ELECTRICAL CONTACT

(71) Applicant: Turck Inc., Plymouth, MN (US)

(72) Inventors: Justin Lee Neisius, Arden Hills, MN (US); Marco Luke Mathias, Minneapolis, MN (US); John Brendan O'Rourke, Brooklyn Park, MN (US)

(73) Assignee: TURCK INC., Plymouth, MN (US)

( * ) Notice: Subject to any disclaimer, the term of this patent is extended or adjusted under 35 U.S.C. 154(b) by 0 days.

(21) Appl. No.: 17/136,048

(22) Filed: Dec. 29, 2020

(65) Prior Publication Data

US 2022/0209430 A1 Jun. 30, 2022

(51) Int. Cl.

| | |
|---|---|
| ***H01R 4/02*** | (2006.01) |
| ***H01R 43/16*** | (2006.01) |
| ***H01R 13/41*** | (2006.01) |
| ***H01R 4/58*** | (2006.01) |

(52) U.S. Cl.

CPC ..... *H01R 4/023* (2013.01); *H01R 4/58* (2013.01); *H01R 13/41* (2013.01); *H01R 43/16* (2013.01)

(58) Field of Classification Search

CPC ..... H01R 4/023; H01R 4/58; H01R 13/41; H01R 13/11; H01R 13/115; H01R 43/16

USPC ..... 439/733

See application file for complete search history.

(56) References Cited

U.S. PATENT DOCUMENTS

| | | | | |
|---|---|---|---|---|
| 2,339,174 | A * | 1/1944 | Kosha | B21D 53/36 439/889 |
| 2,563,761 | A * | 8/1951 | Uline | H01R 13/111 439/851 |
| 4,272,149 | A * | 6/1981 | Gallusser | H01R 13/428 439/426 |
| 5,495,669 | A * | 3/1996 | Legrady | H01R 4/028 29/883 |
| 7,021,963 | B2 * | 4/2006 | Feldman | H01R 9/05 439/578 |
| 7,331,821 | B2 * | 2/2008 | Feldman | H01R 4/02 439/578 |
| 9,917,390 | B1 * | 3/2018 | Bianca | H01R 13/111 |
| 10,541,488 | B2 * | 1/2020 | Zebhauser | H01R 9/0518 |
| 2004/0033733 | A1 * | 2/2004 | Feldman | H01R 9/05 439/843 |
| 2006/0128216 | A1 * | 6/2006 | Feldman | H01R 4/02 439/578 |
| 2020/0295490 | A1 * | 9/2020 | Shinder-Lerner | H01R 11/05 |

FOREIGN PATENT DOCUMENTS

| | | | | |
|---|---|---|---|---|
| EP | 0025368 | A1 * | 3/1981 | H01R 13/111 |
| EP | 1798820 | A1 * | 6/2007 | H01R 4/02 |

* cited by examiner

*Primary Examiner* — Peter G Leigh

(74) *Attorney, Agent, or Firm* — Leydig, Voit & Mayer, Ltd.

(57) ABSTRACT

An electrical contact includes: a first end; a second end; and a solder cup section formed at the first end. The solder cup section conductively connects to an electric component including a wire, by soldering. The solder cup section has a circumferential wall region with an upper edge defining a solder cup opening at the first end, and a solder cup base, which is arranged opposite the solder cup opening and which defines a base of the solder cup section. The electrical contact is stamped and formed from a metal sheet.

13 Claims, 3 Drawing Sheets

ELECTRICAL CONTACT, SYSTEM AND METHOD FOR MANUFACTURING AN ELECTRICAL CONTACT

FIELD

The present invention relates to an electrical contact with a first end and a second end, a system comprising a plurality of such electrical contacts, and a method for manufacturing an electrical contact.

BACKGROUND

Electrical contacts are widely used for connecting electrical appliances. In many cases, one or more electrical contacts are held by or embedded in a contact holder, typically made out of an isolating material.

Typically, a "male" and "female" geometry, in particular pin and socket geometry, of contacts at one end is used to provide corresponding contacts that can be (temporarily) connected to each other. Typically, an end opposite to the male/female form is provided with a conductive connection to an electric component, in particular one or more electrical wires.

For connecting the electrical contact with a wire, different methods can be used. For example, crimping can be a highly efficient and fast way to connect an electrical contact to one or several wires. Also, soldering can be used.

Also, electrical contacts can be manufactured in different ways, thereby achieving different properties of contacts and providing suitable contacts for different applications.

For example, machined contacts and stamped contacts with crimped connections are known. Machined contacts are made from conductive a metal rod, which is machined down to the desired geometry to produce the parts. Also, stamped contacts are known, which are created by using a flat sheet of conductive material and stamping and forming the contact into the desired geometry. Typically, a stamped and formed contact is provided with a section for crimping and thereby connecting to a wire. The flat sheet metal material is especially suitable for this type of connection.

For some applications, it is preferred to use soldering for connecting wires to a contact. In such applications, machined contacts are typically used. However, machined contacts are more expensive and slower to produce than stamped contacts.

SUMMARY

In an embodiment, the present invention provides an electrical contact, comprising: a first end; a second end; and a solder cup section formed at the first end, the solder cup section being configured to conductively connect to an electric component comprising a wire, by soldering, wherein the solder cup section comprises a circumferential wall region with an upper edge defining a solder cup opening at the first end, and a solder cup base, which is arranged opposite the solder cup opening and which defines a base of the solder cup section, and wherein the electrical contact is stamped and formed from a metal sheet.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
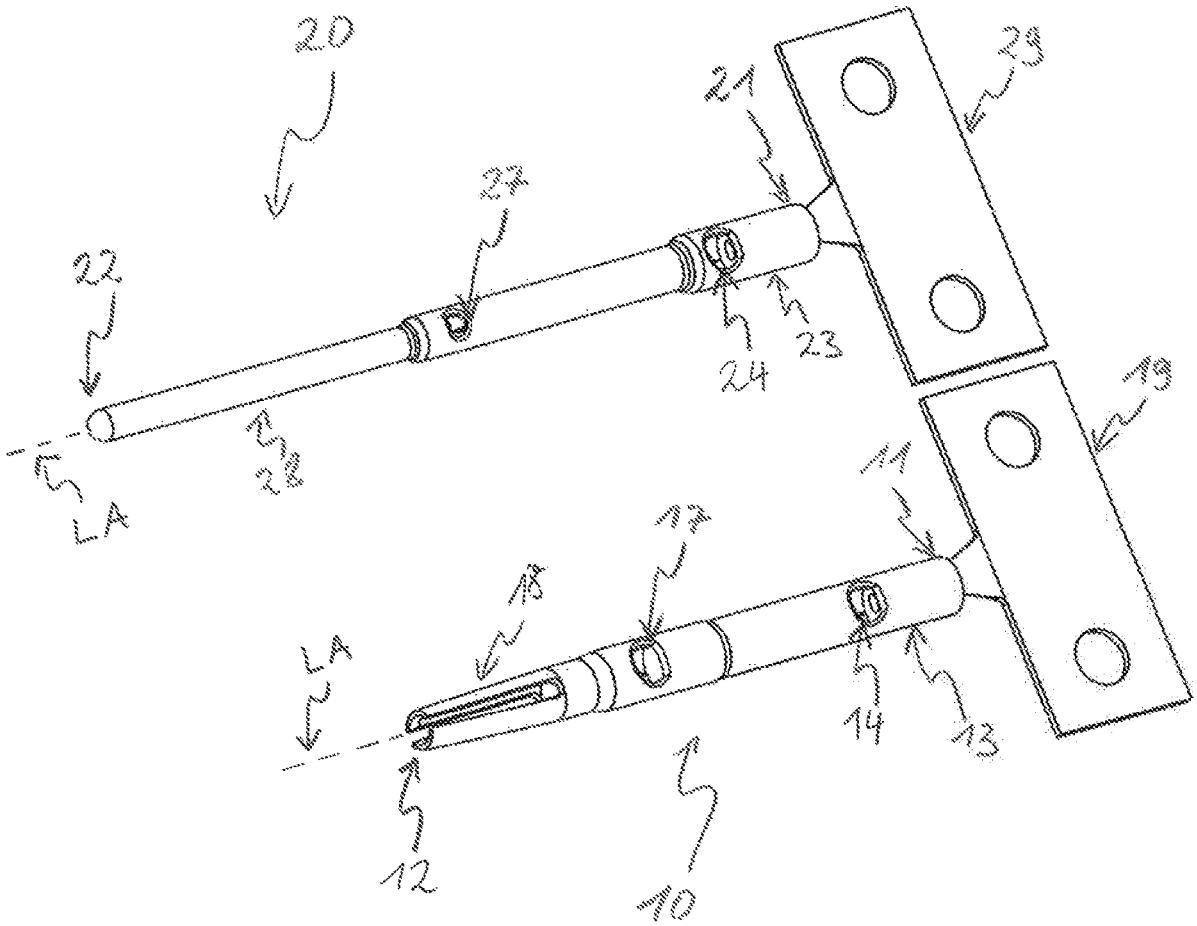
FIG. 1 shows a perspective view of a first and second embodiment from a first side.

In an embodiment, the present invention provides an electrical contact, which is cost-effective and easy to use. In particular, the electrical contact should be efficiently and reliably connected to electrical components and wires by soldering. Furthermore, electrical contacts should be provided that can be inserted into contact holders before being connected to electrical wires.

In an embodiment, the present invention provides an advantageously an improved electrical contact, a system and a method for manufacturing an electrical contact, in particular with respect to manufacturing costs, robust connections and simple use.

This problem is solved by an electrical contact, a system and a method as described herein.

In an embodiment, the present invention relates to an electrical contact with a first end and a second end. Therein, a solder cup section is formed at the first end and is configured for being conductively connected to an electric component, in particular to a wire, by soldering. Also, the solder cup section comprises a circumferential wall region with an upper edge defining a solder cup opening at the first end of the electrical contact, and a solder cup base, which is arranged opposite to the solder cup opening and which defines a base of the solder cup section. Furthermore, the electrical contact is stamped and formed from a metal sheet.

One basic idea of the invention is providing an electrical contact with a solder cup design for connection to electrical wires, producing this contact by stamping and forming from sheet metal.

Since stamped and formed parts are much less expensive per part than machined contacts, the electrical contact of to the invention can be produced very cost-efficiently. Also, when electrical contacts are machined, large quantities of material are machined away and are therefore wasted. On the other hand, stamped and formed contacts can be produced with much less waste.

Also, the invention has the advantage that the electrical contacts can be inserted into a contact holder before they are connected to wires. In most of such cases, crimp contacts cannot be used, since the tight spacing of the contacts in the contact holder does not allow crimping after insertion. On the other hand, it can be difficult to insert contacts that are already connected to wires into a contact holder, because the wires can get in the way and cause difficulties with the insertion operation. These difficulties during assembly can lead to higher labor costs per product produced. Thus, the invention requires an advantageously low amount of work, when the electrical contacts are used.

The solder cup section may be configured to hold solder material, and to take up a wire, being heated to melt the solder material and being cooled down to harden the solder material. Thus, a permanent conductive connection is created between the electric contact material, solder material and wire or another electrical component.

Also, the solder cup base provides a stop for a wire or conductor of an electrical component, which is introduced into the solder cup. Thus, the soldering process can be performed in a highly defined way.

In particular, the solder cup opening is configured to introduce solder material and wire into a volume defined by the solder cup base, the circumferential wall and the solder cup opening. The solder cup opening may be circular or essentially circular; it may also be shaped such that the upper edge defines essentially a circle in a plane perpendicular to the longitudinal axis of the electrical contact, or the upper edge of the opening may be of a different shape.

The electrical contact may have a male or female geometry at the second and, which is opposite to the solder cup section at the first end. Also, hermaphrodite contact geometries are known and can be used for the electrical contact of the invention.

The electrical contact's the solder cup base may be formed by an essentially round tab, which is stamped out of the metal sheet and bent towards a longitudinal axis of the electrical contact, and towards the solder cup opening.

The solder cup base may have a drain opening. For example, this drain opening may be arranged essentially in the middle of the solder cup base. In particular, the drain opening is configured such that it is suitable to provide a drain for plating solution, when the electrical contact is plunged into such a solution during the plating process. Thus, excess plating solution is avoided in the plating process.

Also, an inspection opening may be arranged in the circumferential wall of the solder cup section. In particular, the inspection opening is configured such that a level of solder material or solder volume and distribution inside the solder cup section can be inspected. In particular, the inspection opening may be formed between adjoining longitudinal edges of the metal sheet, from which the electrical contact is formed. For example, the inspection opening may be formed by recesses in opposing edges of the flat metal sheet blank; after forming the electrical contact, these recesses form the inspection opening. Further, the inspection opening may be arranged at one side of the electrical contact, in particular opposed to the opening formed by stamping out the rounded tab, which is then bent to form the solder cup base.

The electrical contact may be formed, e.g., from bronze, or a bronze material. Also, other metals and metal alloys may be used as well as composite materials. Optionally, the electrical contact may have a nickel, tin and/or gold plating. Other suitable plating methods and/or treatments can be applied additionally or alternatively.

Furthermore, the electrical contact may comprise a barrier tab. The barrier tab may be arranged between the base section of the solder cup section and the second end of the electrical contact. In particular, the barrier tab is stamped out from the metal sheet, and bent towards the longitudinal axis of the electric contact, similar to the tab forming the solder cup base. The barrier tab may be configured to retain solder materials and/or other material and prevent it from getting closer to the second end of the electrical contact. Also, the barrier tab may be configured to define a maximum depth for a male connection geometry engaging with a female connection geometry.

Another aspect of the invention relates to a system comprising a plurality of electrical contacts according to the present disclosure. The electrical contacts are embedded in or inserted into a contact holder, wherein the contact holder comprises an electrically insulating material. For example, the contact holder may be formed of or comprise an insulating plastic material, into which the electrical contacts are inserted. The system may be configured such that the electrical contacts may be inserted into the contact holder, before a conductive connection to a wire or electrical component is provided by soldering.

Another aspect of the invention relates to a method for manufacturing an electrical contact according to the present disclosure. Therein, a conductive metal sheet is provided, and the electrical contact is stamped and formed from the conductive metal sheet. A solder cup section is obtained by bending a rounded tab towards a longitudinal axis of the electrical contact. Optionally, a plating is applied to the electrical contact.

In particular, the method serves the purpose of operating the ultrasound system. Thus, it has the same advantages as the ultrasound system of the invention.

The following figures illustrate preferred embodiments of the present invention. These embodiments are not to be construed as limiting but merely to enhance the understanding of the invention together with the following description. In these figures, same reference signs refer to features throughout the drawings that have the same or an equivalent function and/or structure.

Similar and/or corresponding features are described for several embodiments simultaneously, which is not to be construed as implicating that these features are necessarily configured equally.

In FIG. 1, a first embodiment of an electrical contact 10 with a female geometry is shown as well as a second embodiment of an electrical contact 20 with a male geometry.

Both electrical contacts 10, 20 are shown with an attached tab 19, 29, which is a remainder of a metal sheet, from which these contacts 10, 20 are stamped and formed. These tabs 19, 29 are removed, when the contacts 10, 20 are installed in a contact holder, for example.

Both electrical contacts 10, 20 have a generally tubular form with a longitudinal axis LA.

The electrical contact 10 with a female geometry hat a first 11 and second end 12. At the second end 12, a female mating geometry 18 is arranged.

Similarly, the electrical contact 20 with a male geometry has also a first 21 and second end 22. At the second end 22, a male mating geometry 28 is arranged.

The female 18 and male mating geometry 28 are configured such that corresponding electrical contacts 10, 20 are provided, i.e., the mating geometries 18, 28 can be reversibly attached to each other, in particular by inserting a plug-like structure of the male mating geometry 28 into the socket-like structure of the female mating geometry 18, wherein the female mating geometry 18 is configured to provide a clamping or otherwise holding force, thereby retaining the male mating geometry 28.

At the first end 11, 21 of each electrical contact 10, 20, a solder cup section 13, 23 is provided.

In these embodiments, the solder cup section 13, 23 is defining a volume that is delimited by a solder cup opening 11, 21 at the first end 11, 21, by a circumferential wall of the electrical contact 10, 20 in the region of the solder cup section 13, 23, and a solder cup base. In the embodiments 10, 20, the solder cup base is formed by a rounded tab 14, 24, which is formed by a stamped-out part of the electrical contact 10, 20 and bent towards the longitudinal axis LA of the electrical contact 10, 20. Thus, the rounded tab 14, 24 is bent towards the inside of the otherwise tubular electrical contact 10, 20.

In the embodiments, the rounded tab 14, 24 is bent into such a position that it extends essentially in a plane perpendicular to the longitudinal axis LA and forms a base section of the solder cup section 13, 23.

The size of the rounded tab 14, 24 is such that its outer edge essentially abuts an inner surface of the electrical contact 10, 20 at the base of the solder cup section 13, 23.

As the tab 14, 24 is stamped out of the metal sheet material forming the side wall of the electrical contact 10, 20, and bent towards the longitudinal axis LA, an opening with essential the form of the tab 14, 24 is formed in the electrical contact 10, 20 below the solder cup section 13, 23, i.e., between the solder cup section 13, 23 and the second end 12, 22.

Also, in the present embodiments, a drain opening is formed in the rounded tab 14, 24. The drain opening is herein arranged at the middle of the rounded tab 14, 24 and its dimensions are chosen such that the drain opening extends over about 10% to 50%, preferably between 20% and 40% of the area of the rounded tab 14, 24. The drain opening is configured such that a liquid, which is contained inside the volume of the solder cup section 13, 23, can drain, in particular a plating solution during a plating process can drain.

In further embodiments, which are not shown here, the rounded tab 14, 24 can be formed without a drain opening, in particular when the tab 14, 24 does not close the volume of the solder cup tightly. Also, the drain opening can have a different form or it can be arranged differently. Also, a suitable drain opening may be provided in a side wall of the electrical contact 10, 20.

Also, a barrier tab 17, 27 is stamped from the metal sheet material of the electrical contact 10, 20 at a position between the solder cup section 13, 23 and the second end 12, 22. In the embodiments, the barrier tab 17, 27 is configured and formed similarly to the rounded tab 14, 24 forming the solder cup base 14, 24. Thus, the barrier tab 17, 27 is bent towards the longitudinal axis LA and thus arranged essentially in a plane perpendicular to the longitudinal axis LA.

In the embodiments, the opening of where the barrier tab 17, 27 is stamped out of the metal sheet material is arranged below the position of the barrier tab 17, 27, i.e., between the barrier tab 17, 27 and the second end 12, 22.

Figure 2:
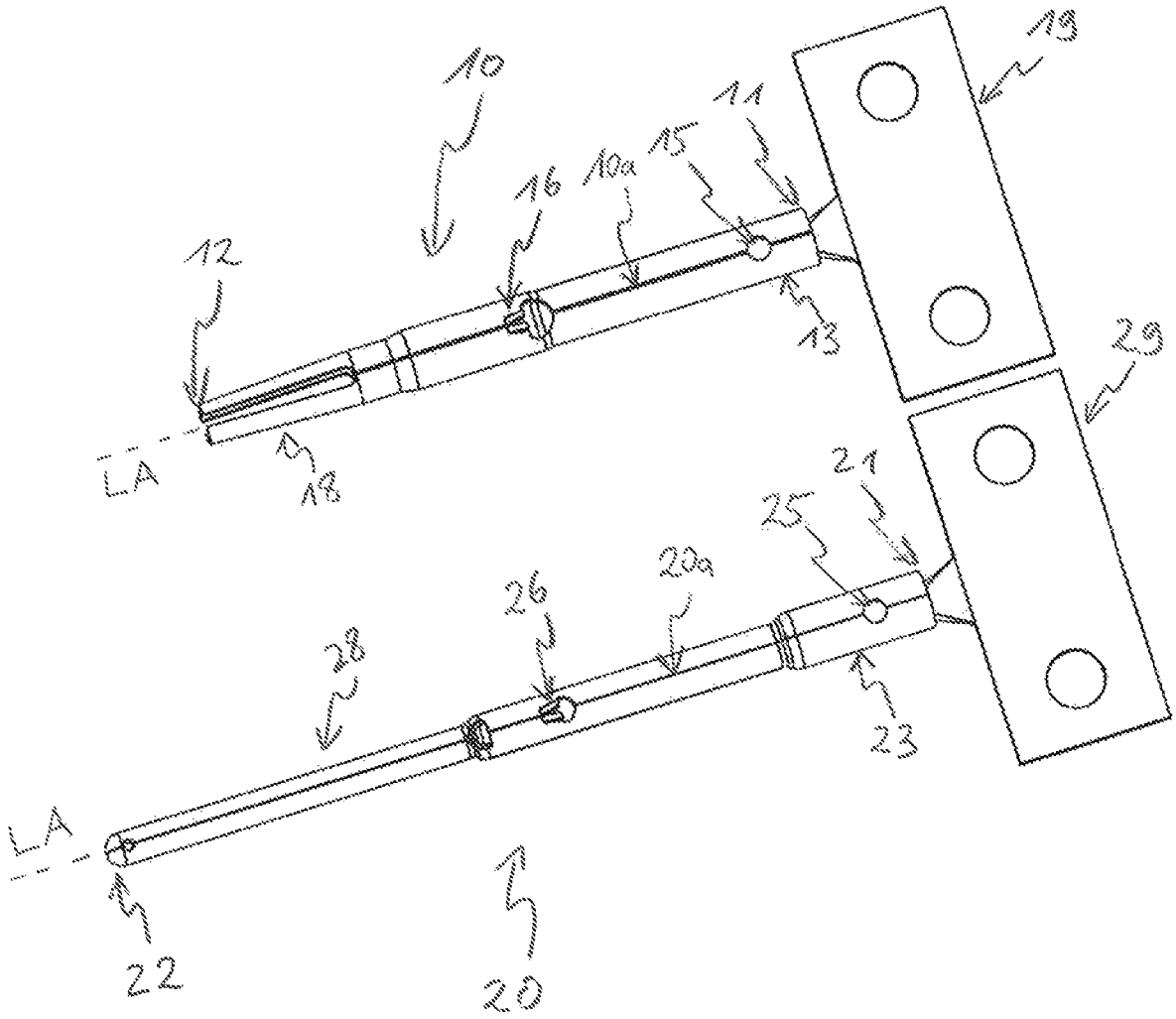
FIG. 2 shows a perspective view of the first and second embodiment from a second side.

In FIG. 2, the first 10 and second embodiment of an electrical contact 20 are shown from an essentially opposite side.

From this perspective, a joint 10*a*, 20*a* is extending along the surface of the electrical contact 10, 20 and parallel to the longitudinal axis LA. This is due to the manufacturing of the electrical contact 10, 20 by stamping and forming from a metal sheet. At the joint 10*a*, 20*a*, the edges of a stamped-out form are brought into contact with each other during the forming process.

The electrical contacts 10, 20 have each an inspection opening 15, 25, which is provided at the solder cup section 13, 23, i.e. between the position of the solder cup base 14, 24 and the first end 11, 21.

In the embodiments, the inspection opening 15, 25 is circular and is formed by two symmetric halves, which are provided at each side of the joint 10*a*, 20*a*.

In further embodiments, the inspection opening 15, 25 can be configured differently, e.g., with an oblong or rectangular shape and/or not provided at the joint 10*a*, 20*a*.

The inspection opening is configured such that it allows inspecting the arrangement of a solder material and/or a wire or electrical component inside the volume of the solder cup section 13, 23. Also, a soldering result can be inspected, e.g., in order to verify a wanted distribution of solder material.

Furthermore, the electrical contact 10, 20 of both embodiments is provided with a retention barb 16, 26, which is arranged and configured similar to the inspection opening 15, 25 at the joint 10*a*, 20*a*. The retention barb 16, 26 is configured to allow in interlocking interaction between the electrical contact 10, 20 and a contact holder, when the electrical contact 10, 20 is inserted into an opening of the contact holder, thereby biting into the holder material.

To this end, the retention barb 16, 26 may have a pointed tip or spike, which protrudes outwards, i.e., away from the longitudinal axis LA of the electrical contact 10, 20.

In both embodiments the electrical contacts 10, 20 are made of a bronze material and plated with a plating comprising nickel, tin and/or gold. Other suitable plating methods and/or treatments can be applied additionally or alternatively.

Figure 3:
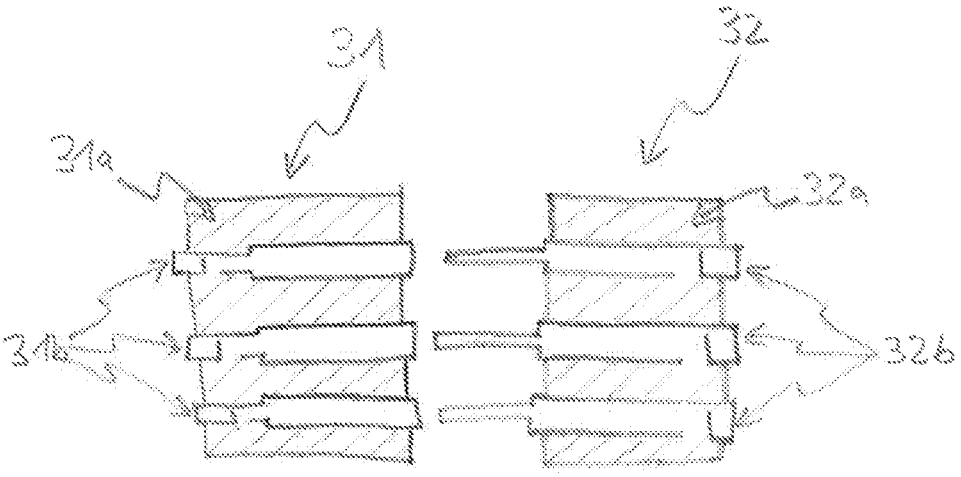
FIG. 3 shows a first and second embodiment of a system with electrical contacts.

Turning to FIG. 3, a first and second embodiment of a system 31, 32 comprising a contact holder 31*a*, 32*a* and a plurality of electrical contacts 31*b*, 32*b* are described.

Each contact holder 31*a*, 32*a* is made of an insulating plastic or polymer material. Electrical contacts 31*b*, 32*b* are inserted into openings of the contact holder 31*a*, 32*a*.

Herein, the electrical contacts 31*b*, 32*b* correspond essentially to the ones described above. They are manufactured by stamping and forming from a metal sheet.

In particular, the electrical contacts 31*b*, 32*b* have a female (31*b*) and male (32*b*) mating geometry, respectively. Thus, the systems 31, 32 are configured complementary to each other and they can be temporarily be connected to each other as plugs.

Also, the systems 31, 32 are configured such that the electrical contacts 31*b*, 32*b* are inserted without being connected to a wire or other electrical component. Instead, connections are only later formed by soldering. Therefore, the material of the systems contact holders 31*a*, 32*a* is chosen such that—at least in the regions surrounding the solder cups of the electrical contacts 31*b*, 32*b*—it can withstand the temperatures, which are experienced during soldering.

Figure 4:
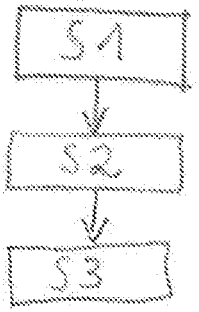
FIG. 4 shows an embodiment of a method for manufacturing an electrical contact.

Turning to FIG. 4, an embodiment of the method for manufacturing an electrical contact according to the present disclosure is described.

In a first step S1, a metal sheet is provided and a flat blank is stamped. The blank is formed and shaped such that, in a second step S2, an electrical contact is obtained by forming the blank.

In particular, a rounded tab is stamped out and bent towards a longitudinal axis of the electrical contact, thereby defining a solder cup base of a solder cup section at a first end of the resulting electrical contact.

In a third step S3, a plating is applied to the surface of the electrical contact. To this end, the electrical contact is submerged in a plating solution, plated, e.g., by electroplating, and removed from the plating solution. To allow the plating solution to drain from the electrical contact and its volumes, a drain opening is provided within the rounded tab.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

10 Electrical contact (female geometry)
10*a* Joint
11 First end; solder cup opening
12 Second end
13 Solder cup section
14 Tab; solder cup base
15 Inspection opening
16 Retention barb
17 Barrier tab
18 Mating geometry (female)
19 Tab (metal sheet)
20 Electrical contact (female geometry)
20*a* Joint
21 First end; solder cup opening
22 Second end
23 Solder cup section
24 Tab (solder cup)
25 Inspection opening
26 Retention barb
27 Barrier tab
28 Mating geometry (male)
29 Tab (metal sheet)
31 System
31*a* Contact holder
31*b* Electrical contact (female)
32 System
32*a* Contact holder
32*b* Electrical contact (male)
LA Longitudinal axis
S1, S2, S3 Step

What is claimed is:

1. An electrical contact, comprising:
a first end;
a second end;
a retention barb with a pointed tip or spike protruding away from a longitudinal axis of the electrical contact; and
a solder cup section formed at the first end, the solder cup section being configured to conductively connect to an electric component comprising a wire, by soldering,
wherein the solder cup section comprises a circumferential wall region with an upper edge defining a solder cup opening at the first end, and a solder cup base, which is arranged opposite the solder cup opening and which defines a base of the solder cup section, and
wherein the electrical contact is stamped and formed from a metal sheet.

2. The electrical contact according to claim 1, wherein the electrical contact has a male or female geometry at the second end, which is opposite the solder cup section at the first end.

3. The electrical contact according to claim 1, wherein the solder cup base comprises an essentially round tab, which is stamped out of the metal sheet and bent towards a longitudinal axis of the electrical contact, and towards the solder cup opening.

4. The electrical contact according to claim 1, wherein the solder cup base has a drain opening.

5. The electrical contact according to claim 1, wherein an inspection opening is arranged in the circumferential wall region of the solder cup section.

6. The electrical contact according to claim 5, wherein the inspection opening is formed between adjoining longitudinal edges of the metal sheet, from which the electrical contact is formed.

7. The electrical contact according to claim 1, wherein the electrical contact is comprised of bronze.

8. The electrical contact according to claim 1, wherein a barrier tab is arranged between the base section of the solder cup section and the second end.

9. A system, comprising:
a plurality of the electrical contact according to claim 1,
wherein each of the plurality of electrical contact are embedded in or inserted into a contact holder, and
wherein the contact holder comprises an electrically insulating material.

10. A method for manufacturing the electrical contact according to claim 1, comprising:
providing a conductive metal sheet;
stamping and forming the electrical contact from the conductive metal sheet; and
obtaining a solder cup section by bending a rounded tab towards a longitudinal axis of the electrical contact.

11. The electrical contact according to claim 4, wherein the drain opening is arranged essentially in a middle of the solder cup base.

12. The electrical contact according to claim 7, wherein the electrical contact has a nickel, tin, and/or gold plating.

13. The method according to claim 10, further comprising applying a plating to the electrical contact.

* * * * *